US007552545B2

(12) United States Patent
Crawford et al.

(10) Patent No.: US 7,552,545 B2
(45) Date of Patent: Jun. 30, 2009

(54) DUCTED DRYING RACK FOR CLOTHES DRYER

(75) Inventors: James F. Crawford, Newton, IA (US); Laurel A. Dillon, Marion, IL (US); Donald E. Erickson, Newton, IA (US); Jeff D. Maddox, Nebraska City, NE (US); Mark A. Tucker, Buncombe, IL (US)

(73) Assignee: Maytag Corporation, Benton Harbor, MI (US)

( * ) Notice: Subject to any disclaimer, the term of this patent is extended or adjusted under 35 U.S.C. 154(b) by 323 days.

(21) Appl. No.: 11/257,527

(22) Filed: Oct. 25, 2005

(65) Prior Publication Data

US 2007/0089317 A1 Apr. 26, 2007

(51) Int. Cl.
*F26B 11/18* (2006.01)

(52) U.S. Cl. ..... 34/600; 34/192; 34/237; 34/195

(58) Field of Classification Search ..... 34/139, 34/237, 238, 192, 194–197, 600, 609, 68, 34/109, 239, 90, 103, 202; 312/228, 228.1, 312/292, 213, 311, 237; 248/215
See application file for complete search history.

(56) References Cited

U.S. PATENT DOCUMENTS 2,298,352 A * 10/1942 Downes ..... 34/109
2,628,432 A 2/1953 Morrison
3,316,659 A 5/1967 Lauck
3,344,532 A 10/1967 Bigler
3,536,287 A * 10/1970 Hyman ..... 248/301
3,724,095 A 4/1973 Laue et al.
3,756,679 A * 9/1973 Schoenfelder ..... 312/237
4,091,548 A 5/1978 Daily
4,908,959 A 3/1990 Kretchman et al.
D314,262 S 1/1991 Kretchman et al.
6,026,592 A 2/2000 Herr

* cited by examiner

*Primary Examiner*—Kenneth B Rinehart
(74) *Attorney, Agent, or Firm*—Clifton Green; Michael D. Lafrenz

(57) ABSTRACT

A drying rack assembly, for use in a clothes dryer with a rotatable tumbler, is constructed with a perforated tray to support clothing in a stationary manner within the tumbler. A duct is attached to the perforated tray to direct a primary airflow through the perforated tray and to at least a portion of air outlet opening in the tumbler cavity. The duct further includes openings to provide a secondary path by which a portion of the total airflow is allowed to bypass the perforated tray. A movable damper is provided to allow variable bypass airflow. An air outlet cover, attached to the combination of the duct and perforated tray, is adapted to cover the portion of the air outlet opening that does not interface with the duct. The air outlet cover is movable to a second position to enable compact storage. A hanging feature is further provided on the side of the dryer cabinet to provide a convenient storage space.

22 Claims, 8 Drawing Sheets

DUCTED DRYING RACK FOR CLOTHES DRYER

BACKGROUND OF INVENTION

1. Field of Invention

The present invention relates to clothes dryers. More particularly, the present invention relates to the construction of a selectively removable drying rack for use with a clothes dryer.

2. Discussion of Prior Art

Conventional clothes dryers include a cabinet with a rotatable drum mounted between stationary front and rear walls or bulkheads. Typically, the drum includes an air inlet opening in the rear wall, with a grate extending over the air inlet opening to prevent tumbling clothing from entering. A heater is provided for supplying heated air through the inlet opening to facilitate drying of the laundry. The heated air travels in a generally axial path through the drum to an air outlet grid located in the front wall. During normal operation of the clothes dryer, clothes are pulled against the outlet grid by the heated air passing through the drum. The temperature within the drum is controlled by at least one thermostat located downstream from the air outlet grid.

There are various structures presently known in the art to provide support for delicate items that, because of their nature, cannot be subjected to the normal tumbling action of a clothes dryer. A typical prior art device is comprised of a rack that is mounted within the dryer, but remains stationary instead of rotating with the drum. This prior art rack is generally a grate-like structure that allows air to freely flow through the clothing. Therefore the items placed on the rack are subjected to the heated airflow, but are not subjected to the tumbling action of the rotating drum.

One disadvantage of a drying rack such as the one mentioned above is that the heated airflow may pass through the drum without actually passing through the clothing. The result is a slower, less-efficient drying operation than could otherwise be accomplished.

An attempt to address this problem can be found in U.S. Pat. No. 4,908,959. The drying rack depicted in this patent includes a channel added to the underside of the grate-like structure of the rack in order to create a closed airflow path from the rack to the air outlet grid. This construction effectively forced substantially all of the airflow to pass through or nearby the articles placed on the grate-like structure. However, this construction still suffers from one or more of the following disadvantages. One problem that is apparent is the situation where the clothing article to be dried substantially covers the entire gridwork of the rack, and reduces the airflow volume, thus increasing the temperature of the incoming air. Further, the clothing placed on the drying rack creates an airflow restriction that is upstream from the controlling thermostats and delays the ability of the thermostats to react to rapidly rising temperatures. The result is that the clothing, often composed of fabrics of a delicate nature, are subjected to a higher than desired temperature. To address this drawback, a recommendation is made to consumers to use only unheated air or the lowest temperature setting available. This approach leaves ample room for consumer error.

Another disadvantage of the prior art ducted drying rack is that excessive storage space is required. The drying rack is quite tall due to the channel that interfaces with the air outlet grid, or due to the mounting features that place the drying rack in a stationary position in the drum. Consumers typically have little storage space in their laundry rooms, and since the drying rack is used infrequently, storage can become a nuisance.

Thus, it is a primary object of the present invention to provide a ducted drying rack to be used in a clothes drying appliance that improves over the state of the art.

It is a further object of the present invention to provide a drying rack with a profile that permits easy storage.

A still further object of the present invention is to strike balance between drying delicate articles with the aid of an improved ducted drying rack as quickly and efficiently as possible while maintaining acceptable clothing temperatures at all available temperature settings.

These and/or other objects, features, or advantages of the present invention will be apparent from the specification and claims that follow.

SUMMARY OF THE INVENTION

A drying rack constructed in accordance with the present invention overcomes the disadvantages in the art by creating at least two paths for the normal stream of heated air in the clothes dryer. Additionally, the storage space required for the drying rack is reduced by providing a movable flap that can be placed in one position to create the desired airflow paths, and in a second position to provide a reduced height profile for storage. Further, a hook is also provided on the clothes dryer cabinet to create a convenient storage space for the drying rack when not in use.

Issues associated with elevated clothing temperatures are alleviated by providing bypass air holes in the duct. Additionally, the consumer is given some degree of control in choosing the temperature to which clothing will be subjected by providing a variable area for bypass air.

Specifically, the drying rack of the present invention includes a perforated grate-like tray adapted for drying articles of clothing without being tumbled by the dryer drum. A duct is included below the tray as part of the drying rack to create an airflow path through the perforated tray and direct this airflow, via the duct, to the air outlet opening. A second airflow path is created downstream of the tray to allow a portion of the total airflow to bypass the tray. An adjustable shutter system provides a variable percentage of bypass air.

The provision of a compact drying rack for enhanced storage is addressed in at least three ways. First, the mounting features are incorporated within the height of the perforated tray. Second, the cross-sectional area of the duct is minimized by the provision of an air outlet cover or hinged flap that covers the portion of the drum outlet grid that does not directly interface with the duct. Third, a hook is provided on the side of the clothes dryer cabinet to permit the drying rack assembly to rest along the side of the cabinet with the perforated tray in a substantially vertical orientation.

Preferably, the drying rack mounting features are confined to the perforated tray. This allows for model differentiation by the manufacturer by providing the opportunity to utilize the perforated tray of the drying rack with or without the duct attached.

The air outlet cover 34 is molded from polypropylene, or other suitable plastic material, with integral hinge pins 58 to allow relative rotational motion in relation to the duct 32. There is a transitional region 62 with a smooth radius to direct the airflow to the air outlet duct 46 (shown in FIG. 3). At the end of the transitional region 62 is an overlap region 35 that rests against the inside wall of the bottom panel 54. This overlap region 35 serves to limit the rotation of the air outlet cover 34. The hinge features and overlap are adapted to place the face 37 of the air outlet cover 34 in contact with the outlet grid 44 when the dryer rack assembly 16 is installed. As shown in FIG. 3, the air outlet cover 34 is shaped to cover the portion of the outlet grid 44, below the bottom panel 54 of the duct 32, that would otherwise allow heated airflow to bypass the drying rack assembly 16.

Based on the above, it should be readily apparent that the invention provides a compact, ducted drying rack that addresses the storage and fabric temperature issues associated with known ducted drying racks. In any event, additional objects, features and advantages of the invention will become more readily apparent from the following detailed description of a preferred embodiment of the invention, when taken in conjunction with the drawings wherein like reference numerals refer to corresponding parts in the several views.

DETAILED DESCRIPTION OF THE INVENTION

The present invention will now be described as it applies to its preferred embodiment. While it is not intended that the present invention be limited to only the described embodiment, it is intended that the invention encompass all alternatives, modifications, and equivalencies apparent to those skilled in the art and that may be included within the spirit and scope of the invention.

Figure 1:
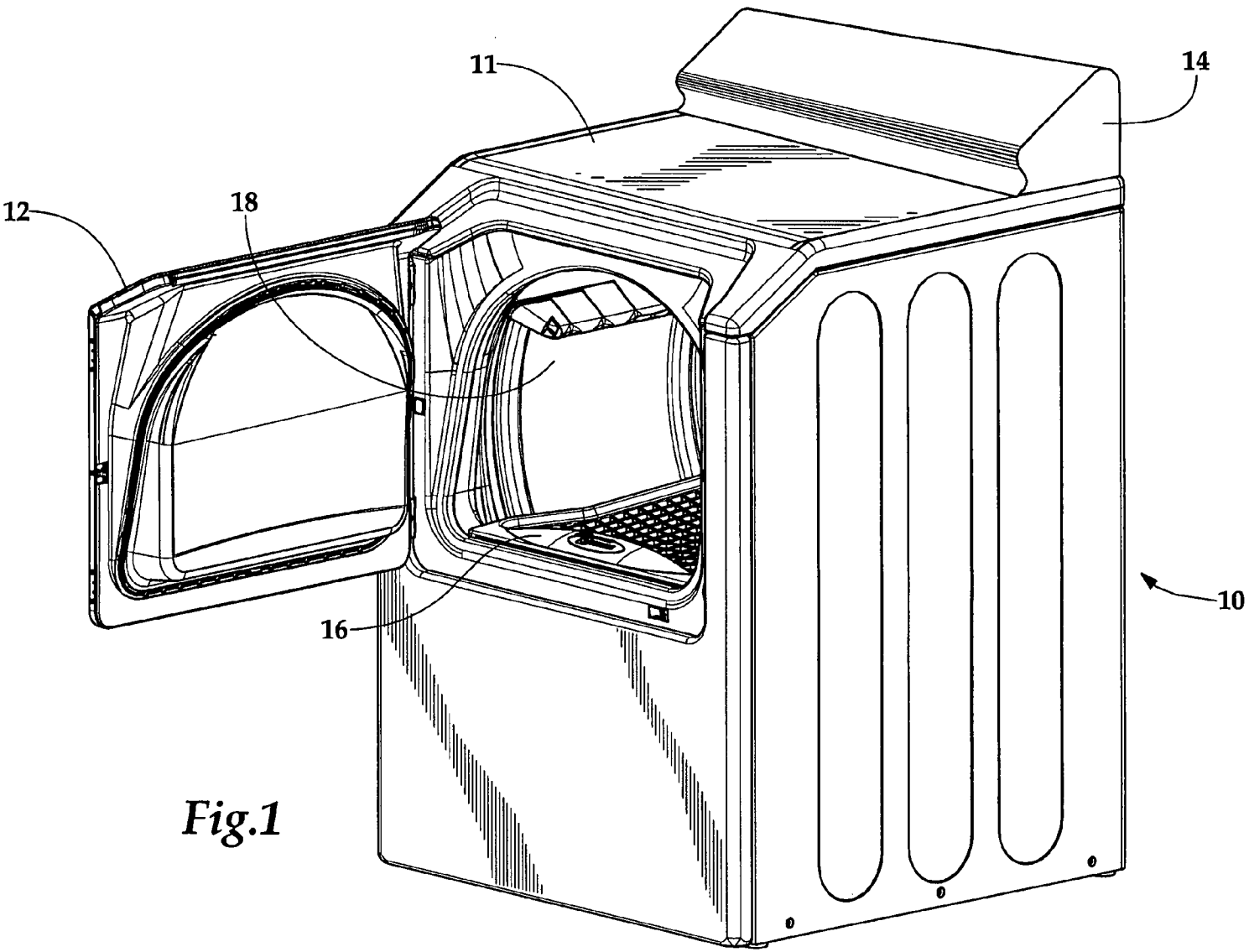
FIG. 1 is a perspective view of a clothes dryer with the drying rack of the present invention installed within the tumbler of a clothes dryer.

FIG. 1 shows a clothes dryer 10 including a top cover 11, an access door 12 and a control panel 14. The drying rack assembly 16 is shown assembled within the rotatable drum or tumbler 18.

Figure 2:
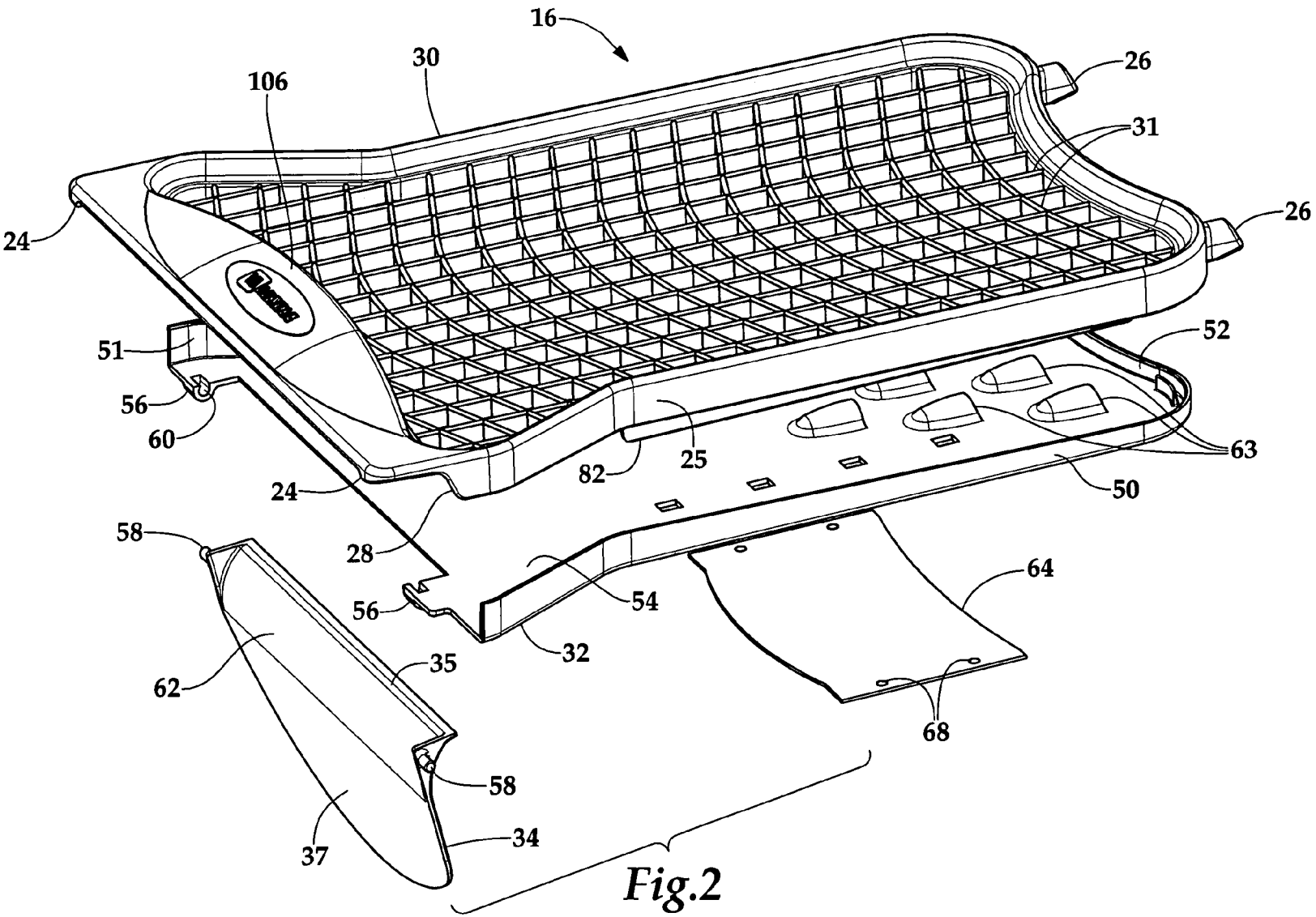
FIG. 2 is an exploded view of the drying rack assembly.

FIG. 2 displays the drying rack assembly 16 composed of a perforated tray 30, duct 32 and air outlet cover 34. The perforated tray 30 is molded from polypropylene, or other suitable plastic material, and has a gridwork 31 that supports articles of clothing placed thereon and allows for the passage of air.

The duct 32 is molded from polypropylene, or other suitable plastic material, with a bottom panel 54 and upwardly extending side walls 50, 51, 52. The fourth side wall is omitted to allow an exit point for the air that flows through the duct 32. The duct 32 further includes recesses 56 to accept the hinge pins 58 of air outlet cover 34. The recesses 56 have a cylindrical shape with the inner wall 60 having a periphery that is slightly greater than 180 degrees in order to create a snap-fit retention of the hinge pins 58. Because of the flexibility of the plastic material, the recesses 56 will deflect slightly during the insertion of the hinge pins 58.

The air outlet cover 34 is molded from polypropylene, or other suitable plastic material, with integral hinge pins 58 to allow relative rotational motion in relation to the duct 32. There is a transitional region 62 with a smooth radius to direct the airflow to the air outlet duct 46 (shown in FIG. 3). At the end of the transitional region 62 is an overlap region 35 that rests against the inside wall of the bottom panel 54. This overlap region 35 serves to limit the rotation of the air outlet cover 34. The hinge features and overlap are adapted to place the face 37 of the air outlet cover 34 in contact with the outlet grid 44 when the dryer rack assembly 16 is installed. The air outlet cover 34 is shaped to cover the portion of the outlet grid 44 that would otherwise allow heated airflow to bypass the drying rack assembly 16.

Figure 4:
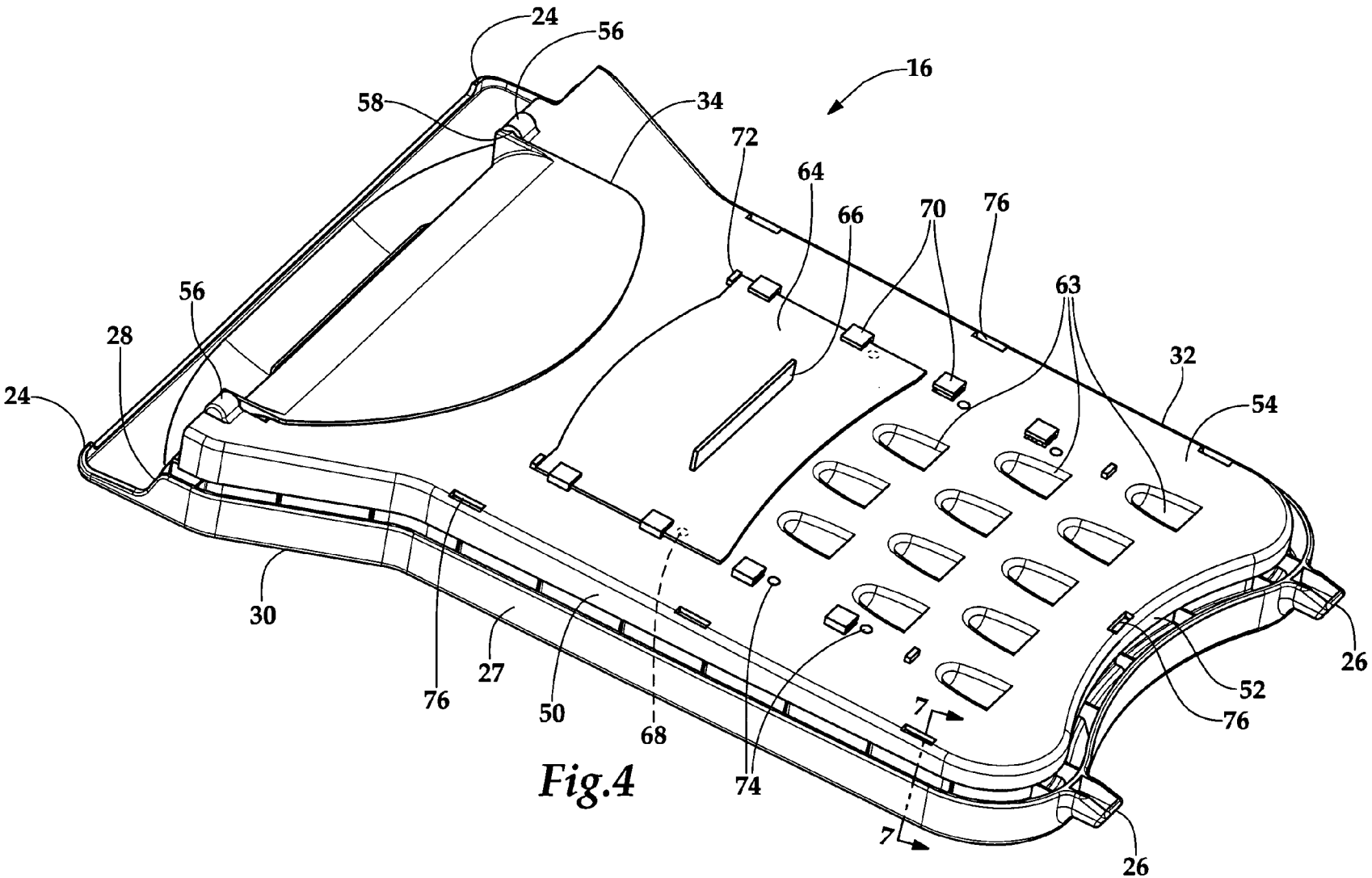
FIG. 4 is a perspective view of the bottom of the drying rack assembly showing the air by-pass holes with the damper open.
Figure 7:
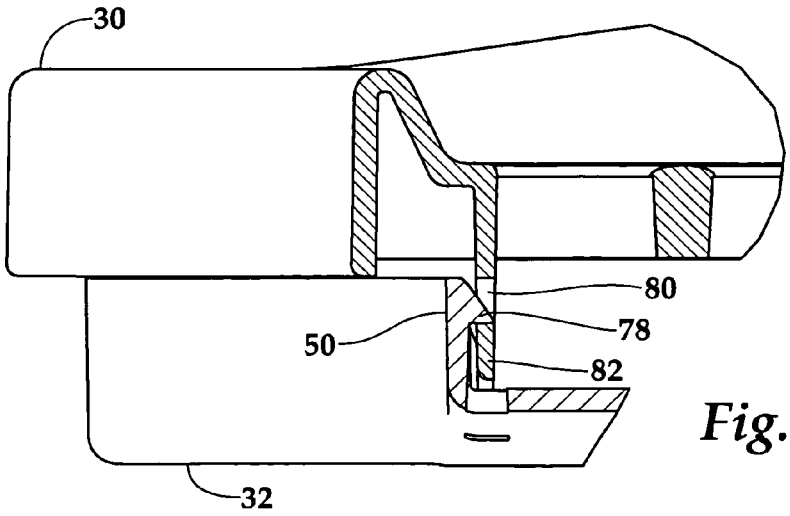
FIG. 7 is an enlarged, cross-sectional view taken along the lines 7-7 of FIG. 4, showing a snap-fit connection portion of the drying rack assembly of the invention.

As best shown in FIG. 4, the sub-assembly consisting of the duct 32 and air outlet cover 34 is attached to the perforated tray 30 through a plurality of snap features 76. As further shown in FIG. 7, hooks 78 are molded in side walls 50, 51, 52 of duct 32. Corresponding holes 80 are provided in downwardly depending ribs 82 of perforated tray 30. The snap features 76 are provided at numerous locations on side walls 50, 51, 52.

Figure 3:
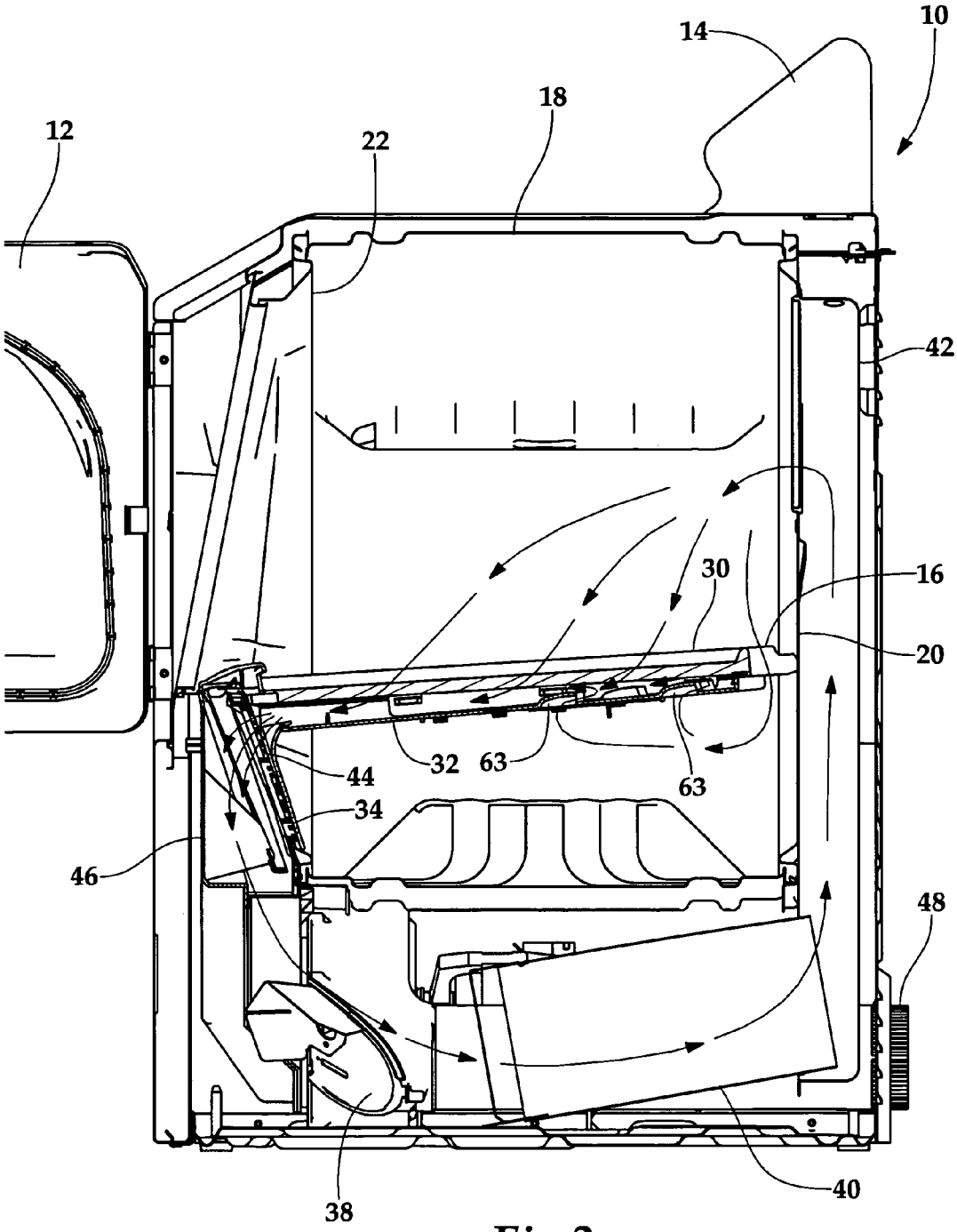
FIG. 3 is a cross-sectional side view of the clothes dryer and drying rack assembly of FIG. 1.

With reference to FIG. 3, the tumbler 18 is cylindrically shaped and is mounted for rotation between a tumbler back 20 and a tumbler front 22. When the clothes dryer 10 is in operation, the tumbler 18 rotates in order to tumble the clothes placed therein. The tumbler back 20 and tumbler front 22 remain stationary as the tumbler 18 rotates.

Figure 6:
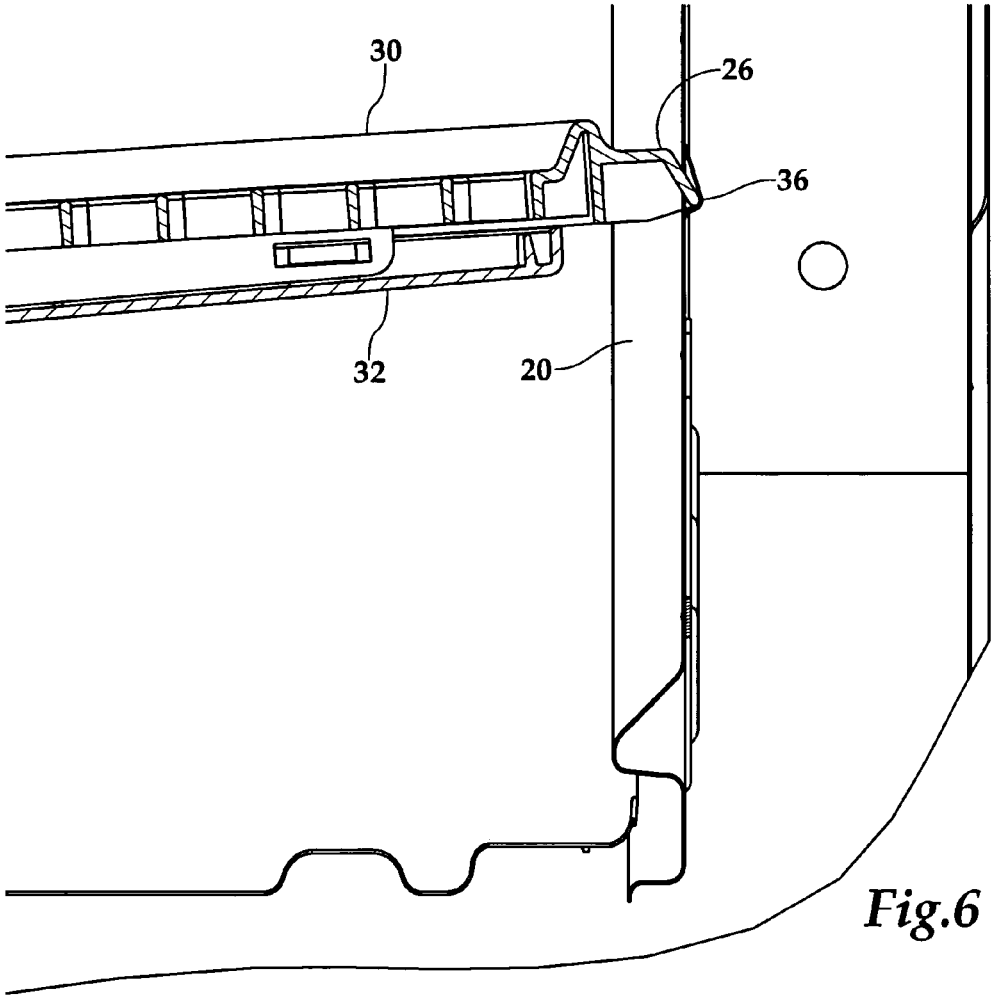
FIG. 6 is an enlarged cross-sectional view of the rear mounting features of the drying rack assembly.

The drying rack assembly 16 is adapted to be mounted within the tumbler 18 and is supported at each end by the tumbler back 20 and the tumbler front 22, and thus the drying rack assembly 16 does not rotate with the tumbler 18. The perforated tray 30 includes a pair of downwardly depending front flanges 24, FIG. 4, that rest on the tumbler front 22 at the bottom of the opening to the tumbler 18. Also included are pegs 26 that are adapted to nest in formed cups 36 (FIG. 6) in the tumbler back 20. Additionally, the tray side walls 25, 27 each include a front chamfer 28 that rests against the tumbler front 22 near the bottom of the opening therein to perform a wedging action that maintains the pegs 26 within the cups 36 in the tumbler back 20.

Although the drying rack is shown to be simply supported at the front and rear of the tumbler 18, the novel features of the present invention could be employed on a drying rack that is mounted at only one end in a cantilever manner.

The arrows in FIG. 3 indicate the path of airflow through the clothes dryer 10. The dryer blower 38 draws air through the heater 40. The heated air is then pulled upward through the inlet duct 42 and introduced to the tumbler 18. Because the drying rack assembly 16 includes the mostly-enclosed duct 32, the air is forced to travel through and near the clothing placed on the perforated tray 30 as it is pulled through the porous gridwork 31.

A second airflow path is shown where a portion of the total airflow is pulled through the bypass air holes 63 in the bottom panel 54. The portion of the total airflow passing through the bypass air holes 63 is dependent on the degree to which the gridwork 31 is covered by the articles to be dried. The airflow traveling between the duct 32 and the perforated tray 30 is forced to flow through the outlet grid 44 of the outlet duct 46. From the outlet duct 46, the air flows through the blower 38 and is expelled from the clothes dryer 10 via the exhaust duct 48.

Note in FIG. 3 that the hinged and rotatable air outlet cover 34, due to the force of gravity, has rotated to a position resting against the outlet grid 44. The air outlet cover 34 fulfills an important objective of the present invention. As can be appreciated, if not for the air outlet cover 34, the duct 32 would need to occupy a height many times taller than shown in order to direct the airflow from the gridwork 31 to the outlet grid 44.

As shown in FIG. 4, the air outlet cover 34 can rotate to a position where it rests against the bottom panel 54 of the duct 32. It is in this manner that the drying rack assembly 16 is manufactured in a form that is easily stored.

One fundamental purpose of a drying rack is to allow delicate items to dry in a stationary fashion. Due to the nature of these delicate fabrics, it is also desirable to limit the air temperature to which the fabric is subjected. It has been shown through testing that in cases where the fabric to be dried substantially covers the gridwork 31 of the perforated tray 30, the temperature of the heated air increases rapidly. Because the temperature controlling thermostat (not shown) is located downstream on the blower 38, the blockage created by the clothing causes the thermostat to have a slower responsiveness to rapidly rising temperatures. This may result in higher than desired clothing temperatures.

As shown in FIG. 4, bypass air holes 63 are provided in the bottom panel 54. This secondary path for airflow serves two purposes. First, in cases where the fabric to be dried substantially covers the gridwork 31, the airflow volume is improved to keep the rate of the air temperature rise lower. Second, a path is maintained to provide this airflow to the blower 38 where the temperature-controlling thermostat, not shown, is mounted. In this manner, the thermostat is better able to react to the rising air temperature. The resulting maximum air temperature is controlled to a lower temperature than can be expected without the bypass air holes 63.

As further shown in FIG. 4, a sliding damper 64 provides a variable, bypass airflow. The damper 64 is molded from a suitable plastic material and includes an integrally molded handle 66 to facilitate adjustment of damper 64. The bottom panel 54 of duct 32 includes tabs 70 molded in parallel rows to retain the damper 64. Due to the flexible nature of the plastic, the damper 64 can be deformed during the assembly process to enable insertion of the damper 64 under the tabs 70.

Figure 5:
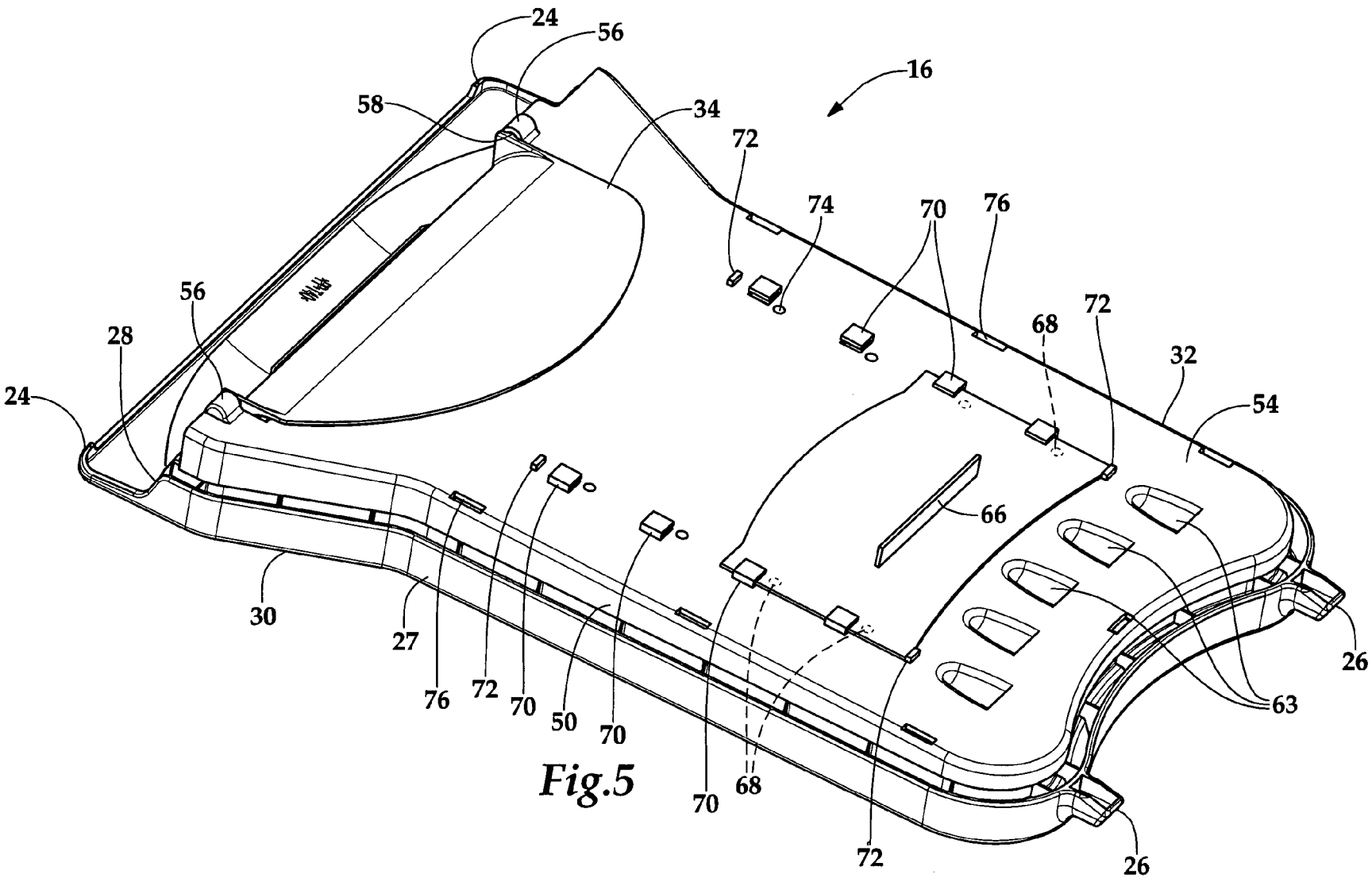
FIG. 5 is a perspective view of the bottom of the drying rack assembly with the damper in a closed position.

The consumer/operator has the ability to select the degree of bypass airflow desired in direct relationship to the degree to which the fabric covers the gridwork 31. For example, if the gridwork is substantially covered, it is desirable to position the damper 64 to provide a great degree of bypass air as shown in FIG. 4. In comparison, if the gridwork 31 is largely uncovered by the article to be dried, the damper 64 may be positioned as shown in FIG. 5 to provide a lesser amount of bypass air. An intermediate position is also provided.

Various features are provided in the bottom panel 54 to create discrete positions for the damper 64. Stops 72 are provided at each end of the damper travel to keep the damper 64 assembled under the tabs 70. Additionally, spherical domes 68 are molded in the damper 64, and corresponding spherical dimples 74 are molded into the bottom panel 54. The alignment of the domes 68 and dimples 74 provide a positive retention feature at the discrete locations described above.

The description of bypass air holes 63 in the bottom panel 54 is not intended to be limiting. As can be appreciated, there are numerous acceptable embodiments for the creation of an air path that bypasses perforated tray 30. For instance, the holes could be located in the side walls 50, 51, 52 or air outlet cover 34. Further, it has been demonstrated through testing that the removal of one side wall 50, 51, 52 of the duct 32 results in an acceptable degree of bypass airflow. Still another possible way to create the second airflow path could be to change the size of the air outlet cover 34. The size could be modified such that the air outlet cover 34 does not overlay the entire portion of the outlet grid 44 that does not interface with the duct 32.

Additionally, bypass airflow can be included on ducted drying racks that do not employ the usage of the air outlet cover 34. Other methods for creating the bypass airflow are contemplated and are within the spirit of the present invention.

Figure 8:
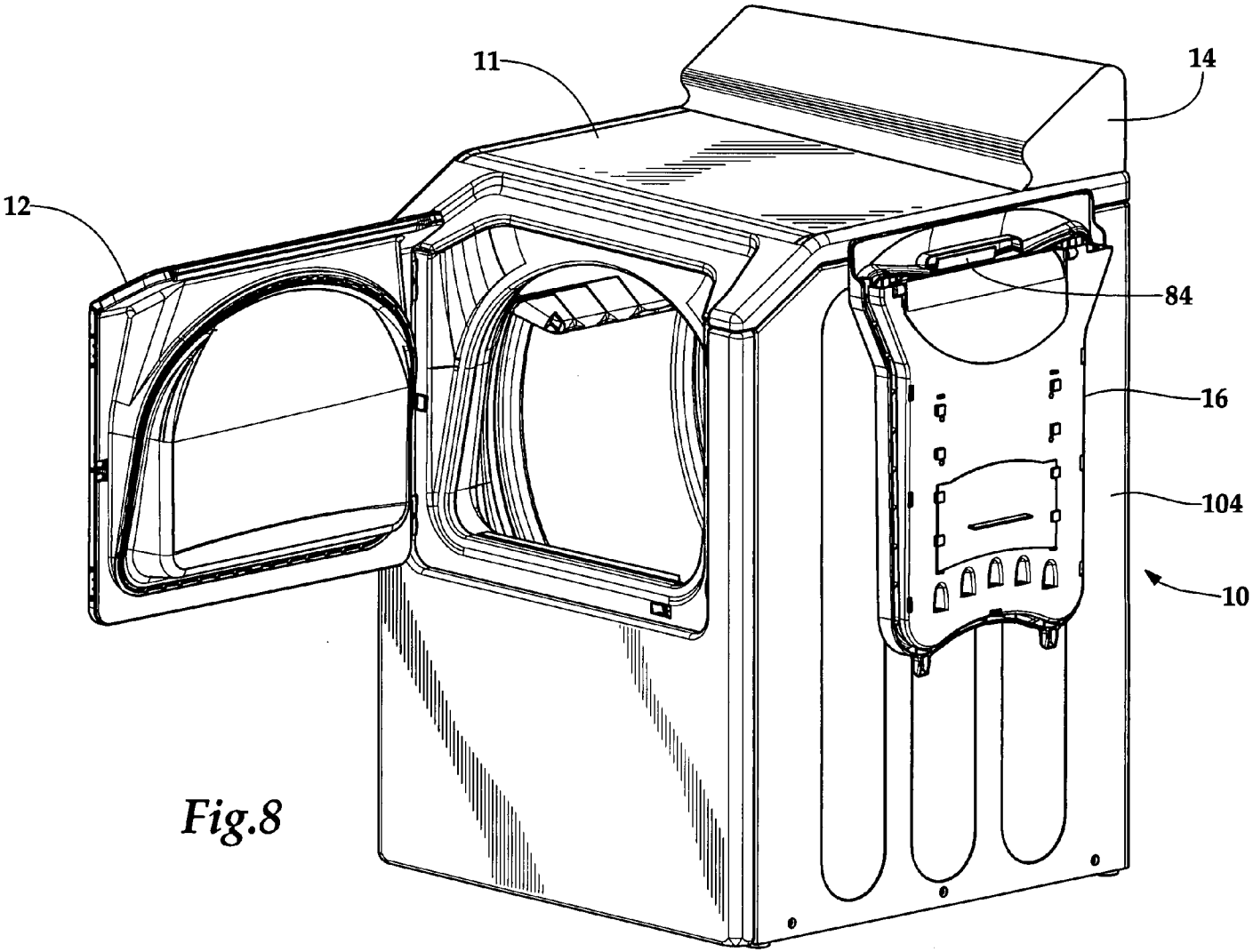
FIG. 8 is a perspective view of the clothes dryer with the drying rack stored on the hanging feature or clip of the present invention.
Figure 10:
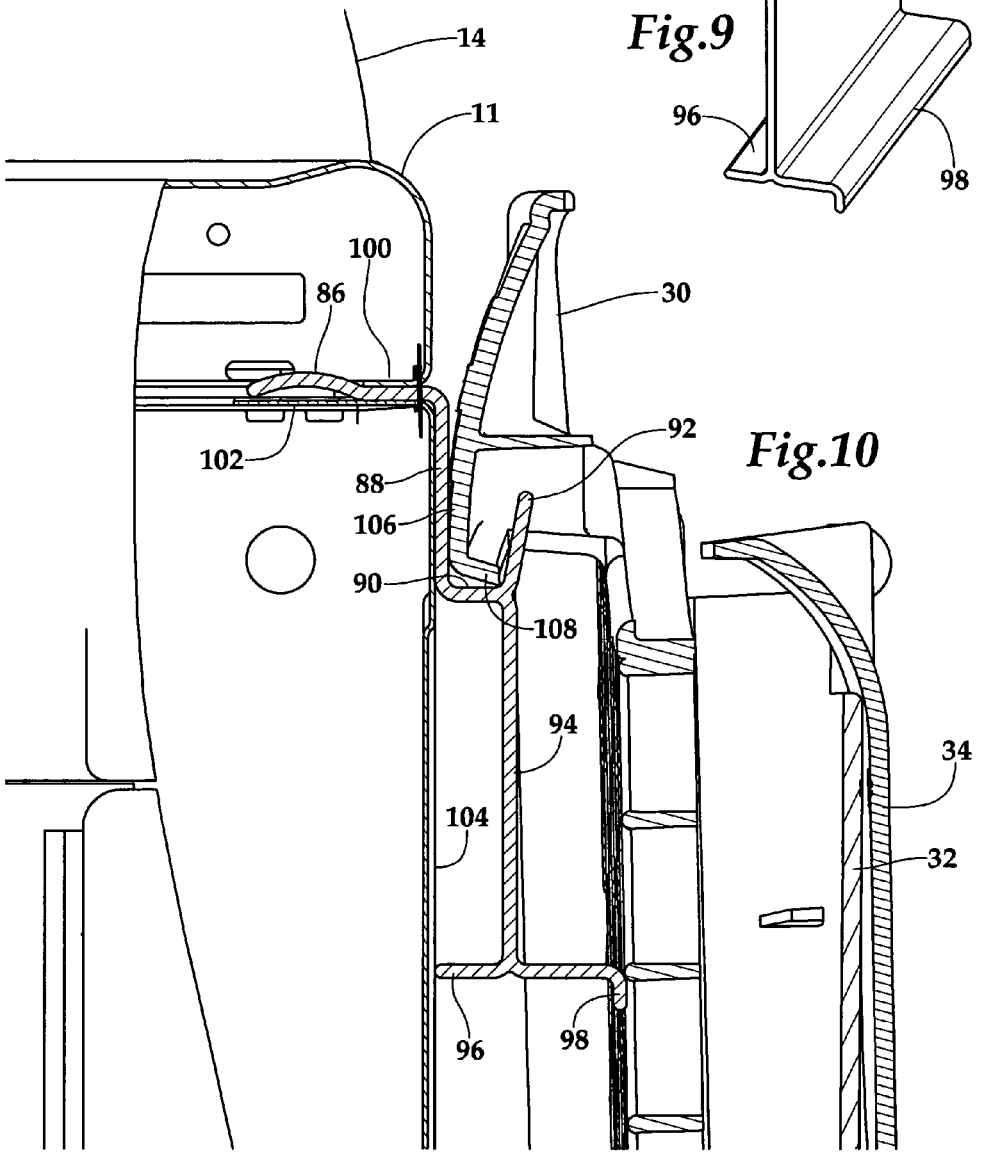
FIG. 10 is an enlarged cross-sectional view of the drying rack assembly mounted on the hanging feature or clip of the present invention.

To further address the consumer's desire for a drying rack that is easily stored during periods of non-use, provision is made to hang the drying rack assembly 16 from the side of the clothes dryer 10 as shown in FIGS. 8 and 10.

The rack 30 is adapted to include a handle 106 (FIG. 2) that serves two purposes. First, the handle 106 is convenient for the consumer to grasp during installation and removal of the drying rack assembly 16 from the clothes dryer 10. Second, the handle 106 is used to interface with a rack hanger 84 to suspend the rack assembly 16 in the storage position on the side of the clothes dryer 10 as shown in FIG. 10. As further shown in FIG. 10, the handle 106 has a down-turned flange 108, the length of which roughly corresponds to the size of support surface 90, for the purpose of stabilizing the rack assembly 16 on the rack hanger 84.

Figure 9:
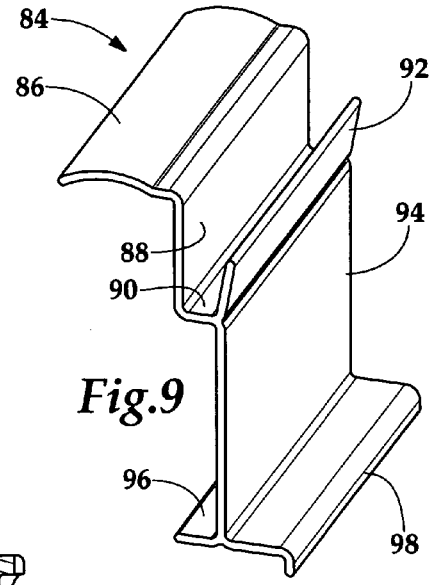
FIG. 9 is a perspective view of the hanging feature or clip of the present invention.

FIG. 9 best shows a drying rack hanger 84 of the present invention. The hanger 84 includes a curved retention flange 86 for attachment to the clothes dryer 10. A first vertical wall 88 is provided to place the rack support surface 90 at an elevation sufficient to position the front edge of the rack assembly 16 just below the top cover 11 of clothes dryer 10.

The rack hanger 84 has a profile that renders it manufacturable as a unitary, or one-piece, part through either injection molding or as an extrusion. The wall thickness is sized to correspond to the gap that exists between the return flange 100 of top cover 11 and the return flange 102 of cabinet side 104. As the curved retention flange 86 is inserted into this gap, the plastic deforms to flatten the flange and allow passage. The flange 86 is inserted into the gap until the back surface of first vertical wall 88 rests against the cabinet side 104. At this point, the curved retention flange 86 returns to its original shape.

A hook feature 92 is upturned from support surface 90 to securely retain the rack assembly 16. In order to support the drying rack 16 in a position substantially parallel to the cabinet side 104 of the dryer 10 so as to prevent vibration noise as from contact between the rack and cabinet, a cabinet standoff rib 96 and rack spacing flange 98 are provided. The rib 96 and flange 98 are spaced from the hook feature 92 via second vertical wall 94 in the direction of the center of gravity of the rack assembly 16. This spacing toward the center of gravity of the rack assembly 16 reduces the horizontal force applied to the hook feature 92. The spacing is sufficient to prevent the weight of the rack from pulling the curved retention flange 86 from the assembled position. Specifically, the horizontal force required to compress the curved retention flange 86 is greater than the force provided by the hanging rack assembly 16.

It is an important feature of the rack hanger 84 that it can be easily and safely assembled to the dryer 10 after shipment to the consumer's home. The curved retention flange 86 and the resiliency of the plastic material enables easy assembly without requiring disassembly of any dryer components.

The preferred embodiment of the present invention has been set forth in the drawings and specification, and although specific terms are employed, these are used in a generic or descriptive sense only and are not used for purposes of limitation. Changes in form and proportion of parts as well as the substitution of equivalents are contemplated as circumstances may suggest or render expedient without departing from the spirit and scope of the invention as further defined in the following claims.

What is claimed is:

1. A drying rack for use with a clothes dryer, the dryer having a rotatable tumbler with air inlet and air outlet openings, and the dryer further having a heated airflow to dry articles within the tumbler, said drying rack comprising:

a perforated rack adapted to be placed within the dryer such that the perforated rack will remain substantially horizontal; and a duct to provide a first airflow path between the perforated rack and at least a portion of the air outlet opening, the duct further including structure adapted to provide a second airflow path, the second airflow path directed through the portion of the air outlet opening that is not covered by the duct allowing air to bypass the perforated rack.

2. The drying rack of claim 1 wherein the perforated rack comprises a top wall and the duct comprises a bottom wall, at least two side walls, a third side wall omitted to provide the second airflow path, the fourth wall open to the air outlet opening.

3. The drying rack of claim 1 wherein the perforated rack comprises a top wall and the duct comprises a bottom wall, three side walls and a fourth side wall in airflow communication with the air outlet opening, at least one of the side walls or bottom wall including openings to provide the second airflow path.

4. The drying rack of claim 3 further comprising a user-adjustable opening area and a damper movable with respect to the adjustable opening area to provide a variable airflow to the second airflow path.

5. The drying rack of claim 1 further comprising an air outlet cover movably attached to the assembly of the perforated rack and the duct, the outlet cover adapted to reside in a first position substantially perpendicular to the perforated rack and covering a portion of the air outlet opening when placed within the dryer, the air outlet cover further movable to a second position substantially parallel to the perforated rack to reduce the height of the drying rack assembly for storage.

6. The drying rack of claim 5 further comprising a pivotal connection of the air outlet cover to the assembly of the perforated tray and the duct.

7. The drying rack of claim 5 wherein the second airflow path is directed through a portion of the air outlet opening that is not covered by the combination of the duct and the outlet cover.

8. A stationary drying rack for use with a clothes dryer, the dryer having a rotatable tumbler, also having tumbler rear and front walls with air inlet and air outlet openings respectively, the dryer further including a heated airflow to dry articles within the tumbler, said drying rack comprising:

a perforated tray with mounting structure for placement of the tray in a substantially horizontal posture;

a duct attached to the perforated tray for providing an airflow path between the perforated tray and a portion of the air outlet opening; and an air outlet cover movably attached to an assembly of the perforated tray and the duct, the air outlet cover adapted to rotate relative to the duct to a first position substantially perpendicular to the perforated tray and in covering relationship to at least a portion of the air outlet opening below the bottom of the duct when the drying rack is placed within the dryer.

9. The drying rack of claim 8 wherein the air outlet cover is further rotatable to a second position substantially parallel to the perforated tray to effectively reduce the height of the drying rack.

10. The drying rack of claim 8 wherein the mounting structure includes at least one peg on the rear of the perforated tray engagable within a formed cup located in the tumbler rear wall and a chamfered surface of a side wall of the perforated tray engagable with the bottom surface of an opening to the tumbler front wall with axial support of the tray provided by the combination of the at least one peg within the formed cup and the interference of the chamfered tray side wall against a vertical surface of the tumbler front wall.

11. The drying rack of claim 8 including duct structure providing a secondary airflow path that bypasses the perforated tray.

12. The drying rack of claim 11 wherein the duct includes a plurality of apertures forming the secondary airflow path.

13. The drying rack of claim 11 wherein the air outlet cover is adapted to partially cover the air outlet opening to provide the secondary airflow path directly from the air inlet opening to the air outlet opening.

14. The drying rack of claim 11 wherein the air outlet cover includes a plurality of apertures in airflow communication with the air outlet opening providing the secondary airflow path.

15. The drying rack of claim 11 wherein the secondary airflow path is provided by adapting the drying rack assembly to leave a portion of the air outlet uncovered by the duct and outlet cover.

16. The drying rack of claim 8 further comprising a pivotal connection of the air outlet cover to the assembly of the perforated tray and the duct.

17. The drying rack of claim 16 wherein the air outlet cover is further movable to a second position substantially parallel to the perforated tray to effectively reduce the height of the drying rack.

18. A ducted drying rack for use with a clothes dryer, the clothes dryer including a cabinet, a top cover and a tumbler mounted for rotation between stationary rear and front walls within the cabinet, the stationary walls having air inlet and air outlet openings respectively, the ducted drying rack comprising:

a perforated tray including structure for mounting the tray in a generally horizontal posture between the rear and front stationary walls;

a duct member attached to the tray for providing an airflow path between the tray and at least a portion of the air outlet opening;

an air outlet cover movably attached to the assembly of the tray and the duct member, the air outlet cover being movable to a first position substantially perpendicular to the tray and in covering relationship over at least a portion of the air outlet opening when the ducted drying rack is mounted within the clothes dryer, the air outlet cover being further movable to a second position substantially parallel to the tray to reduce the height of the ducted drying rack for storage outside of the clothes dryer; and wherein gravitational force acts on the air outlet cover to move the air outlet cover between the first position and the second position when the ducted drying rack is moved from the horizontal posture to a vertical posture for storage.

19. The drying rack of claim 18 further comprising a pivotal connection of the air outlet cover to the assembly of the perforated tray and the duct member.

20. The drying rack of claim 18 further comprising a rack hanging bracket mounted on the side of the clothes dryer for hanging the ducted drying rack with the air outlet cover in the second position to facilitate storage of the ducted drying rack when not in use.

21. The ducted drying rack of claim 20 wherein the rack hanging bracket includes a flange retained in a gap between the cabinet and the top cover.

22. The ducted drying rack of claim 20 wherein the rack hanging bracket is of unitary construction.

* * * * *